US011441494B2

(12) United States Patent
Perfetto

(10) Patent No.: US 11,441,494 B2
(45) Date of Patent: Sep. 13, 2022

(54) BI-FUEL INTERNAL COMBUSTION ENGINE SYSTEMS AND METHODS

(71) Applicant: CUMMINS INC., Columbus, IN (US)

(72) Inventor: Anthony Kyle Perfetto, Columbus, IN (US)

(73) Assignee: Cummins Inc., Columbus, IN (US)

( * ) Notice: Subject to any disclaimer, the term of this patent is extended or adjusted under 35 U.S.C. 154(b) by 149 days.

(21) Appl. No.: 16/208,257

(22) Filed: Dec. 3, 2018

(65) Prior Publication Data

US 2019/0178171 A1 Jun. 13, 2019

Related U.S. Application Data

(60) Provisional application No. 62/596,513, filed on Dec. 8, 2017.

(51) Int. Cl.

| | |
|---|---|
| ***F02D 19/06*** | (2006.01) |
| ***F02D 41/00*** | (2006.01) |
| ***F02D 13/02*** | (2006.01) |
| ***F01L 13/00*** | (2006.01) |
| ***F02B 37/18*** | (2006.01) |

(52) U.S. Cl.

CPC ..... *F02D 19/0634* (2013.01); *F01L 13/0036* (2013.01); *F02B 37/18* (2013.01); *F02D 13/0207* (2013.01); *F02D 41/0025* (2013.01); *F02D 2200/0611* (2013.01)

(58) Field of Classification Search

CPC ..... F01L 13/0036; F01L 1/053; F01L 1/143; F02B 37/18; F02D 13/0207; F02D 19/0634; F02D 2200/0611; F02D 41/0025

See application file for complete search history.

(56) References Cited

U.S. PATENT DOCUMENTS

| | | | | |
|---|---|---|---|---|
| 5,253,621 | A * | 10/1993 | Dopson | F01L 1/25 123/90.16 |
| 6,739,295 | B1 | 5/2004 | Yamaoka et al. | |
| 7,597,072 | B2 | 10/2009 | Stein et al. | |
| 8,807,101 | B2 * | 8/2014 | Choi | F01L 13/0031 123/90.16 |
| 9,127,599 | B2 | 9/2015 | Masubuchi et al. | |
| 2004/0003789 | A1 * | 1/2004 | Kreuter | F01L 1/185 123/90.16 |

(Continued)

*Primary Examiner* — Phutthiwat Wongwian
*Assistant Examiner* — Diem T Tran
(74) *Attorney, Agent, or Firm* — Foley & Lardner LLP

(57) ABSTRACT

A bi-fuel internal combustion engine system includes a first fuel system, a second fuel system, and a bi-fuel internal combustion engine. The bi-fuel internal combustion engine is configured to selectively consume one of a first fuel received from the first fuel system and a second fuel received from the second fuel system. The bi-fuel internal combustion engine includes a camshaft and a valve assembly. The camshaft has a cam. The valve assembly is positioned adjacent the camshaft and configured to interface with the cam. The valve assembly is selectively repositionable between a first position and a second position. The bi-fuel internal combustion engine has a first dynamic compression ratio when the valve assembly is in the first position and a second dynamic compression ratio when the valve assembly is in the second position. The second dynamic compression ratio is greater than the first dynamic compression ratio.

24 Claims, 9 Drawing Sheets

(56) References Cited

U.S. PATENT DOCUMENTS

| | | | | |
|---|---|---|---|---|
| 2005/0161012 | A1* | 7/2005 | Maeda | F01L 13/085 123/182.1 |
| 2008/0092834 | A1* | 4/2008 | Stein | F02D 13/0269 123/90.15 |
| 2012/0060783 | A1* | 3/2012 | Woo | F01L 13/0036 123/90.48 |
| 2016/0222895 | A1 | 8/2016 | Norton | |
| 2016/0281615 | A1 | 9/2016 | Flynn | |
| 2016/0290250 | A1* | 10/2016 | Kurotani | F02D 19/0649 |

* cited by examiner

BI-FUEL INTERNAL COMBUSTION ENGINE SYSTEMS AND METHODS

CROSS-REFERENCE TO RELATED APPLICATIONS

The present application claims priority to and benefit of U.S. Provisional Application No. 62/596,513, filed Dec. 8, 2017 and entitled "Bi-Fuel Internal Combustion Engine Systems and Methods," the disclosure of which is hereby incorporated by reference herein in its entirety.

TECHNICAL FIELD

The present application relates generally to the field of bi-fuel (i.e., dual fuel) internal combustion engines.

BACKGROUND

An internal combustion engine consumes a fuel in at least one combustion process, thereby producing energy which is output by the internal combustion engine (e.g., to a crankshaft, etc.). Internal combustion engines consume fuel in a combustion chamber. Some internal combustion engines are configured to consume a plurality of fuels. An internal combustion engine that is configured to consume two different fuels is known as a bi-fuel internal combustion engine. For example, a bi-fuel internal combustion engine may be configured to consume gasoline and propane. Bi-fuel internal combustion engines are configured to consume only one of the two different fuels in the combustion chamber at a time.

Different fuels often have different fuel properties (e.g., anti-knock index, flash point, etc.). For example, the anti-knock ratio of gasoline is very different from the anti-knock ratio of propane. Bi-fuel internal combustion engines are designed according to the fuel properties of each of the two different fuels. For example, many bi-fuel internal combustion engines are designed to be optimized for the fuel having the lowest anti-knock index. These bi-fuel internal combustion engines are only able to consume, and are not optimized for, the fuel having the highest anti-knock index. As a result, these bi-fuel internal combustion engines do not receive the benefits (e.g., higher output power, increased fuel economy, etc.) associated with being optimized for the fuel having the highest anti-knock index.

SUMMARY

In an embodiment, a bi-fuel internal combustion engine system includes a first fuel system, a second fuel system, and a bi-fuel internal combustion engine. The bi-fuel internal combustion engine is configured to selectively consume one of a first fuel received from the first fuel system and a second fuel received from the second fuel system. The bi-fuel internal combustion engine includes a camshaft and a valve assembly. The camshaft has a cam. The valve assembly is positioned adjacent the camshaft and configured to interface with the cam. The valve assembly is selectively repositionable between a first position and a second position. The bi-fuel internal combustion engine has a first dynamic compression ratio when the valve assembly is in the first position and a second dynamic compression ratio when the valve assembly is in the second position. The second dynamic compression ratio is greater than the first dynamic compression ratio.

In another embodiment, a bi-fuel internal combustion engine includes a delivery system, a camshaft, a valve assembly, and an actuator. The delivery system is configured to selectively receive a first fuel and a second fuel different from the first fuel. The camshaft includes a cam. The valve assembly is positioned adjacent the camshaft and configured to interface with the cam. The actuator is configured to selectively reposition the valve assembly between a first position and a second position. The bi-fuel internal combustion engine has a first dynamic compression ratio when the valve assembly is in the first position and a second dynamic compression ratio when the valve assembly is in the second position. The second dynamic compression ratio is greater than the first dynamic compression ratio.

In still another embodiment, a method for controlling dynamic compression ratio of a bi-fuel internal combustion engine included in a bi-fuel internal combustion system comprising a delivery system, a camshaft having a cam and a valve assembly interfacing with the cam, comprises determining fuel properties of a fuel being supplied to the bi-fuel internal combustion engine by the delivery system. A target fuel property is selected, and a threshold for the target fuel property is determined. The method also includes determining if the target fuel property is above the threshold. In response to the valve assembly being in a second position and a determination that the target fuel property is not above the threshold, the valve assembly is moved to a first position causing the bi-fuel internal combustion engine to have first dynamic compression ratio; and in response to the valve being in the first position and a determination that the target fuel property is above the threshold, the valve assembly is moved to the second position causing the bi-fuel internal combustion engine to have a second dynamic compression ratio greater than the first dynamic compression ratio.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for bi-fuel internal combustion engines. The various concepts introduced above and discussed in greater detail below may be implemented in any of numerous ways, as the described concepts are not limited to any particular manner of implementation. Examples of specific implementations and applications are provided primarily for illustrative purposes.

I. Overview

Bi-fuel internal combustion engines selectively consume two different fuels. For example, a bi-fuel internal combustion engine may consume one fuel for a specific type of operation and another fuel for a different type of operation. Often times, these two fuels have very different fuel properties and cause the bi-fuel internal combustion engine to operate differently depending on which fuel is being consumed. For example, the bi-fuel internal combustion engine may produce more torque and power with one fuel than the other and therefore may be substantially more efficient while consuming one fuel than while consuming the other.

Implementations described herein relate to a bi-fuel internal combustion engine that includes valve assemblies that can be repositioned such that the bi-fuel internal combustion engine operates at similar efficiencies while consuming two different fuels having different fuel properties. In this way, the bi-fuel internal combustion engine described herein is more flexible and desirable than a bi-fuel internal combustion engine that has vastly different efficiencies when different fuels are consumed. The valve assemblies described herein cooperate with a camshaft to be repositioned between two different positions such that an inlet valve closing time of the valve assemblies can be changed to two different values. The inlet valve closing times are selected such that a dynamic compression ratio (e.g., geometric compression ratio, etc.) of the bi-fuel internal combustion engine in one position is greater than in the other position. In various implementations, the bi-fuel internal combustion engine includes a turbocharger having a turbine with a controllable wastegate. The wastegate may be controlled along with the valve assemblies to assist the valve assemblies in achieving a target maximum boost pressure and/or torque level of the bi-fuel internal combustion engine.

II. Example Bi-Fuel Internal Combustion Engine

Figure 1:
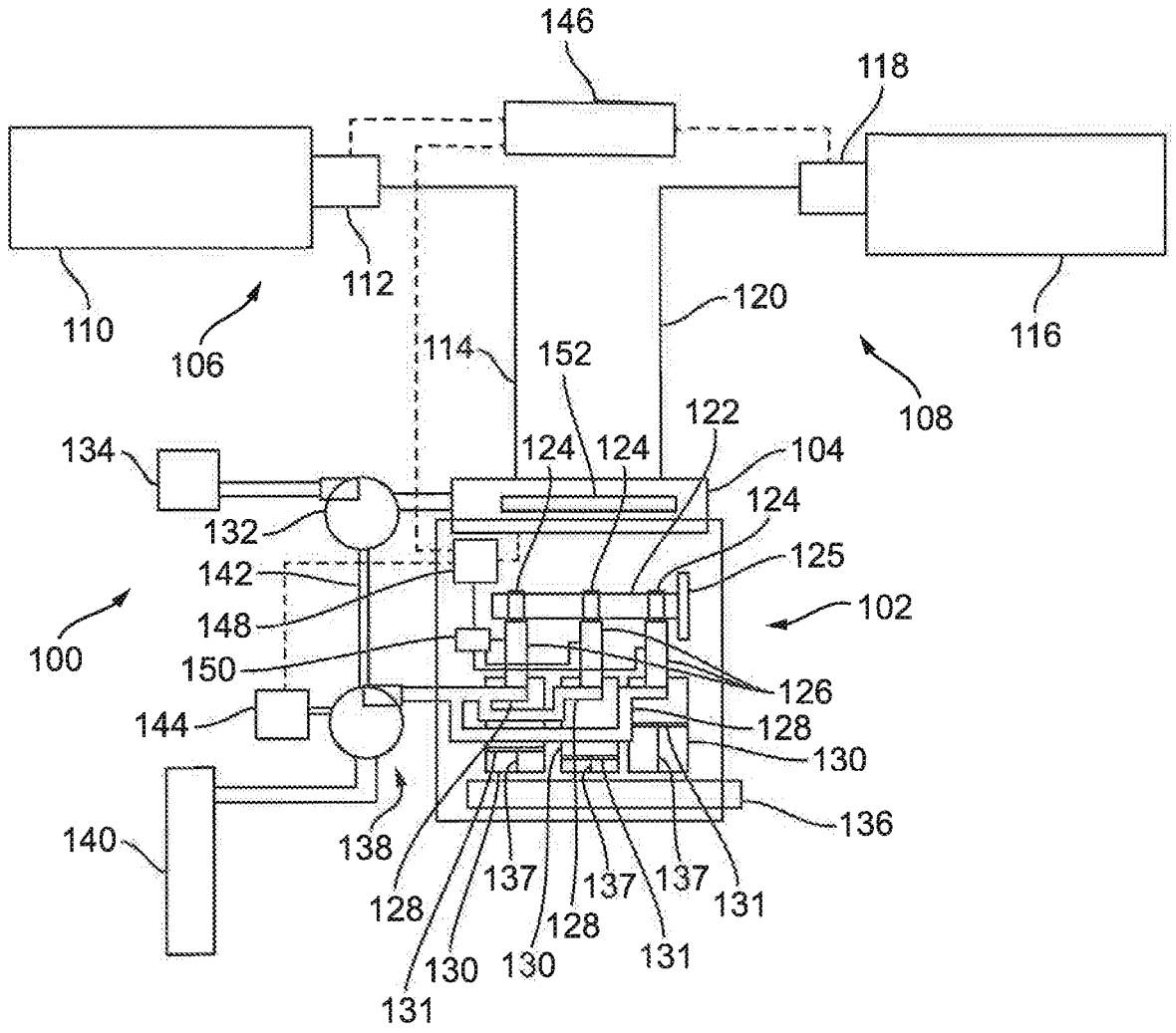
FIG. 1 is a block schematic diagram of an example bi-fuel system having an example bi-fuel internal combustion engine.

FIG. 1 illustrates a bi-fuel internal combustion engine system 100, according to an example embodiment. The bi-fuel internal combustion engine system 100 may be implemented in a vehicle (e.g., commercial vehicle, industrial vehicle, military vehicle, maritime vehicle, etc.), a generator, or other similar applications. The bi-fuel internal combustion engine system 100 includes a bi-fuel internal combustion engine 102. The bi-fuel internal combustion engine 102 is a spark-ignited engine. In various embodiments, the bi-fuel internal combustion engine 102 is a gasoline-propane bi-fuel internal combustion engine. The bi-fuel internal combustion engine 102 has a delivery system 104. The delivery system 104 may include injectors (e.g., fuel injectors, etc.), valves, filters, manifolds, and other similar components.

The bi-fuel internal combustion engine system 100 also includes a first fuel system 106 and a second fuel system 108. The first fuel system 106 is configured to provide a first fuel (e.g., gasoline, diesel, ethanol, natural gas, compressed natural gas, propane, hydrogen, liquefied petroleum gas, etc.) to the delivery system 104 for the bi-fuel internal combustion engine 102 to combust, and the second fuel system 108 is configured to provide a second fuel (e.g., gasoline, diesel, ethanol, natural gas, compressed natural gas, propane, hydrogen, liquefied petroleum gas, etc.), different from the first fuel, to the delivery system 104 for the bi-fuel internal combustion engine 102 to combust. For example, the first fuel may be gasoline and the second fuel may be propane.

In various embodiments, the first fuel and the second fuel have relatively different fuel properties (e.g., anti-knock indices, etc.). For example, the first fuel may be gasoline and may have an anti-knock index (e.g., research octane number (RON), octane rating, octane value, etc.) of ninety, and the second fuel may be liquid propane and may have an anti-knock index of one-hundred and twelve. In another example, the first fuel may be gasoline and may have an anti-knock index of eighty-nine, and the second fuel may be ethanol and may have an anti-knock index of one-hundred and nine. In yet another example, the first fuel may be gasoline and may have an anti-knock index of eighty-eight, and the second fuel may be diesel and may have an anti-knock index of twenty-five. In yet another example, the first fuel may be gasoline and may have an anti-knock index of eighty-seven, and the second fuel may be E85 and may have an anti-knock index of one-hundred and five. In yet another example, the first fuel may be gasoline and may have an anti-knock index of eighty-nine, and the second fuel may be hydrogen and may have an anti-knock index of greater than one-hundred and thirty. In various applications, the second fuel has an anti-knock index that is approximately 5%, 10%, 15%, or 20% different from the anti-knock index of the first fuel.

The first fuel system 106 includes a fuel source 110. The fuel source 110 is configured to store (e.g., contain, hold, etc.) the first fuel. For example, the fuel source 110 may be a fuel tank. The first fuel system 106 also includes a pump 112. The pump 112 is configured to draw the first fuel from the fuel source 110 and to provide the first fuel to a line 114. The line 114 transports the first fuel from the pump 112 to the delivery system 104. The first fuel system 106 may include filters (e.g., fuel filters, etc.), check valves (e.g., to prevent backflow into the line 114, etc.), and other similar components.

The second fuel system 108 includes a fuel source 116. The fuel source 116 is configured to store (e.g., contain, hold, etc.) the second fuel. For example, the fuel source 116 may be a fuel tank. The second fuel system 108 also includes a pump 118. The pump 118 is configured to draw the second fuel from the fuel source 116 and to provide the second fuel to a line 120. The line 120 transports the second fuel from the pump 118 to the delivery system 104. In some embodiments, such as those shown in FIGS. 1 and 2, the line 114 is separate from the line 120. Such an arrangement may be used when, for example, the first fuel is vaporous and the second fuel is a liquid. In other embodiments, the line 114 and the line 120 may be joined into a common line connected to the pump 112 of the first fuel system 106, the pump 118 of the second fuel system 108, and the delivery system 104. Such an arrangement may be used when, for example, both the first fuel and the second fuel are liquid. The second fuel system 108 may include filters (e.g., fuel filters, etc.), check valves (e.g., to prevent backflow into the line 120, etc.), and other similar components.

In an example embodiment, the delivery system 104 is configured to separately receive the first fuel, via the line 114 of the first fuel system 106, and the second fuel, via the line 120 of the second fuel system 108. The delivery system 104 includes injectors for injecting the first fuel and the second fuel into the bi-fuel internal combustion engine 102. In some embodiments, the delivery system 104 includes injectors that are configured to inject both the first fuel and the second fuel into the bi-fuel internal combustion engine 102. Such an arrangement may be used when, for example, both the first fuel and the second fuel are liquid. In other embodiments, the delivery system 104 includes injectors dedicated to the first fuel or the second fuel. Such an arrangement may be used when, for example, the first fuel is vaporous and the second fuel is a liquid. The delivery system 104 may include sensors for determining a concentration of the first fuel and/or the second fuel in the delivery system 104.

The bi-fuel internal combustion engine 102 further includes a camshaft 122 having at least one cam 124. The camshaft 122 is rotatably coupled to a frame (e.g., engine block, etc.) or body within the bi-fuel internal combustion engine 102. The bi-fuel internal combustion engine 102 also includes a cam phaser 125 (e.g., camshaft phase, camshaft phasing device, camshaft actuator, etc.) coupled to the camshaft 122. The cam phaser 125 is operable between a first position, where the cam phaser 125 causes the camshaft 122 to rotate a first rate, and a second position, where the cam phaser 125 causes the camshaft 122 to rotate a second rate different from the first rate. In various applications, the cam phaser 125 is electronically controlled to move between the first position and the second position. In some applications, the cam phaser 125 moves between the first position and the second position in response to oil pressure changes in an oil circulation system of the bi-fuel internal combustion engine 102. The bi-fuel internal combustion engine 102 may have a different dynamic compression ratio when the cam phaser 125 in the first position than when the cam phaser 125 is in the second position. The cams 124 may be uniformly spaced along the camshaft 122 (e.g., with a uniform spacing between adjacent cams 124, etc.) and are configured to rotate along with the camshaft 122.

The bi-fuel internal combustion engine 102 also includes a plurality of valve assemblies 126 (e.g., switching valves, poppet valves, etc.). The number of valve assemblies 126 may be equal to the number of cams 124. The bi-fuel internal combustion engine 102 also includes at least one channel 128 and at least one combustion chamber 130. As shown in FIG. 1, each of the channels 128 receives exhaust gases from an associated combustion chamber 130.

Figure 2:
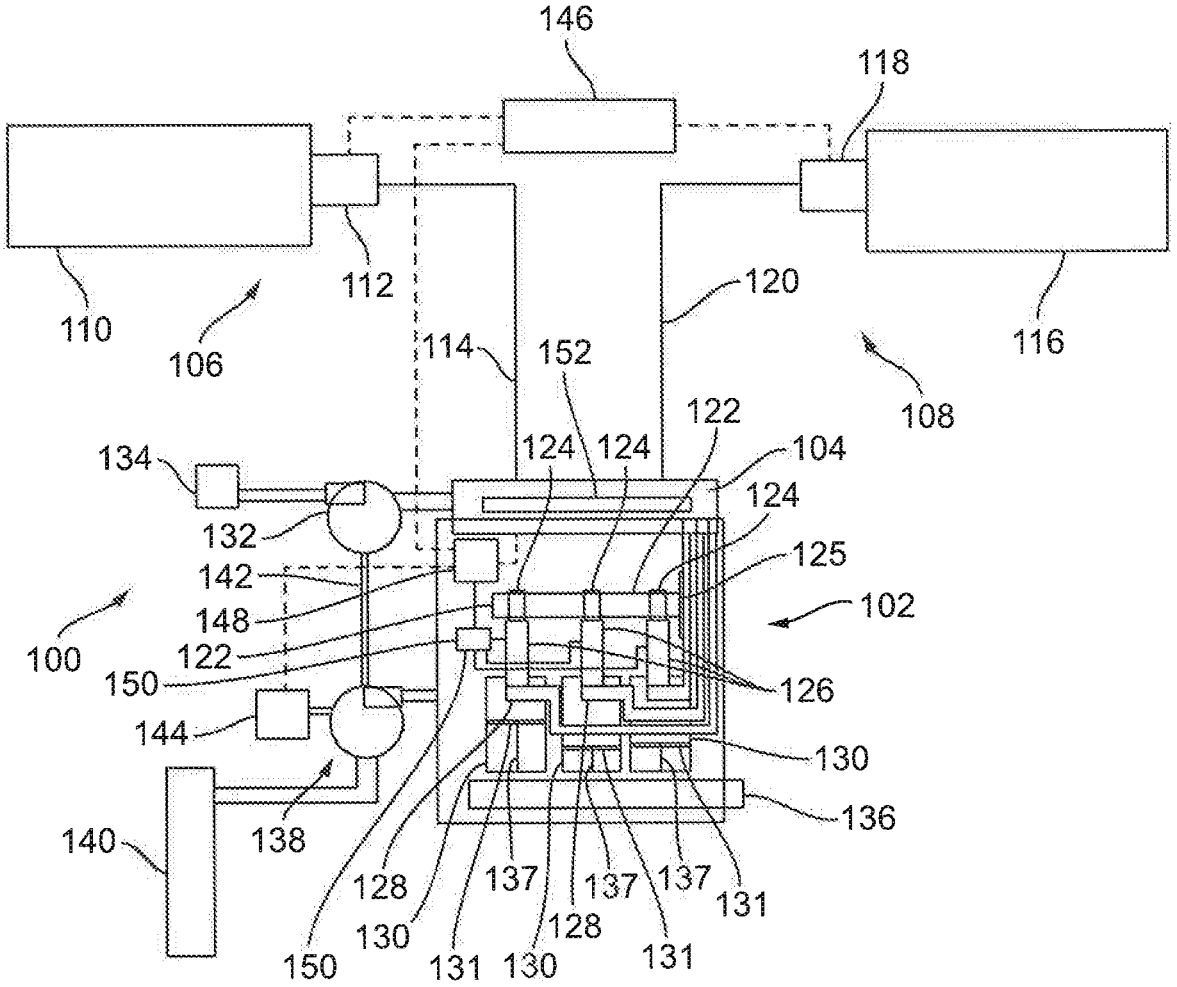
FIG. 2 is another block schematic diagram of the example bi-fuel system shown in FIG. 1.

As shown in FIG. 2, each of the channels 128 is in fluid communication with the delivery system 104 and receives a mixture of air (e.g., provided from an air intake, etc.) and a fuel (e.g., the first fuel, the second fuel, etc.) and provides that mixture to an associated combustion chamber 130. The air is provided to the delivery system 104 from a compressor 132 which receives the air from an air source 134, both of which are included in the bi-fuel internal combustion engine 102. The air source 134 may be, for example, an air intake (e.g., air box, etc.).

Each of the valve assemblies 126 interfaces with one of the cams 124 to transition the valve assembly 126 between a first position (e.g., open position, etc.) and a second position (e.g., closed position, etc.). In the first position, the valve assembly 126 facilitates fluid communication between an associated combustion chamber 130 and an associated channel 128. In the second position, the valve assembly 126 prohibits (e.g., blocks, etc.) fluid communication between an associated combustion chamber 130 and an associated channel 128.

As shown in FIG. 1, when the valve assembly 126 is in the first position, exhaust gases from the combustion of a fuel (e.g., the first fuel, the second fuel, etc.) may be provided from a combustion chamber 130, through the associated channel 128, and out of the bi-fuel internal combustion engine 102 (e.g., to an exhaust conduit, etc.). When the valve assembly 126 is in the second position, fluid communication from a combustion chamber 130 into an associated channel 128 is prohibited. Each of the combustion chambers 130 includes a piston 131, which moves within the combustion chamber 130 in response to combustion within the combustion chamber 130. While the bi-fuel internal combustion engine 102 is described herein as having multiple combustion chambers 130, it is understood that the bi-fuel internal combustion engine 102 may also have a single combustion chamber 130 in some embodiments.

Similarly, as shown in FIG. 2, when the valve assembly 126 is in the first position, a mixture of air and a fuel (e.g., the first fuel, the second fuel, etc.) may be provided through the associated channel 128 and into the associated combustion chamber 130. When the valve assembly 126 is in the second position, fluid communication from a channel 128 into an associated combustion chamber 130 is prohibited.

Energy from combustion of the fuel (e.g., the first fuel, the second fuel, etc.) within the combustion chambers 130 is transferred to a crankshaft 136 via rods 137 (e.g., connecting rods, etc.) attached to the pistons 131. The crankshaft 136 may transfer rotational energy to, for example, a transmission of a vehicle (e.g., an automobile, a commercial vehicle, a military vehicle, a maritime vehicle, etc.). It is understood that the bi-fuel internal combustion engine 102 also includes lubrication systems, coolant systems, and other engine components, which are not shown.

The bi-fuel internal combustion engine 102 also includes a turbine 138. As shown in FIG. 1, the turbine 138 is in fluid communication with the channels 128. In this way, the turbine 138 may receive exhaust gases from the combustion of a fuel (e.g., the first fuel, the second fuel, etc.) with the combustion chambers 130. Exhaust gases from the turbine 138 are provided to an exhaust conduit 140. The exhaust conduit 140 may include, for example, catalytic exhaust treatment devices (e.g., selective catalytic reduction components, catalytic converters, etc.).

The turbine 138 includes a plurality of blades which are rotated (e.g., spun, wound, etc.) by these exhaust gases. The rotational energy produced by the turbine 138 is transferred via a shaft 142 to the compressor 132. In this way, the turbine 138 and the compressor 132 form a turbocharger. The compressor 132 may then compress air received from the air source 134. The turbine 138 includes a wastegate 144 that is configured to purge exhaust gases from within the turbine 138 when a pressure of exhaust gases within the turbine 138 exceeds a threshold, also known as a maximum boost pressure. The exhaust gases may be purged from the wastegate 144 directly to the exhaust conduit 140, thereby exiting the turbine 138.

In some embodiments, the bi-fuel internal combustion engine 102 does not include the turbine 138 and the wastegate 144. For example, the bi-fuel internal combustion engine 102 may not include the compressor 132, the turbine 138, or the wastegate 144. Instead of, or in addition to, the compressor 132, the turbine 138, and the wastegate 144, the bi-fuel internal combustion engine may incorporate a supercharger (e.g., blower, etc.). The supercharger may be similarly communicable with a controller 146 to control a maximum boost pressure of the supercharger (i.e., to alter a performance capability, fuel economy, or torque level of the bi-fuel internal combustion engine 102, etc.).

The bi-fuel internal combustion engine system 100 also includes a controller 146 that is communicably coupled to the pump 112 of the first fuel system 106, the pump 118 of the second fuel system 108, and an engine control unit 148 of the bi-fuel internal combustion engine 102. The controller 146 is operable to control the pump 112 of the first fuel system 106 to selectively draw the first fuel from the fuel source 110 of the first fuel system 106 and provide the first fuel to the delivery system 104; the controller is also operable to control the pump 118 of the second fuel system 108 to selectively draw the second fuel from the fuel source 116 and provide the second fuel to the delivery system 104. In this way, the controller 146 is aware of (e.g., has knowledge of, etc.) which fuel (e.g., the first fuel, the second fuel, etc.), as well as how much of the fuel, is provided to the bi-fuel internal combustion engine 102. The controller 146 may be preprogrammed (e.g., hard-coded, etc.) with knowledge of the first fuel and the second fuel, or the controller 146 may utilize sensors included in the first fuel system 106 and/or the second fuel system 108 to determine the first fuel and/or the second fuel.

The controller 146 may communicate with the engine control unit 148 to control operation of the bi-fuel internal combustion engine 102. The engine control unit 148 is communicable with the delivery system 104, the wastegate 144 of the turbine 138, and an actuator 150 of the bi-fuel internal combustion engine 102. The engine control unit 148 may control a throttle 152 (e.g., inlet valve, etc.) within the delivery system 104 to provide additional air and/or fuel to the channels 128. The engine control unit 148 may also control the wastegate 144 to selectively purge exhaust gases from the turbine 138, such as when the pressure of the exhaust gases within the turbine 138 exceeds the maximum boost pressure. Similarly, the engine control unit 148 may control the wastegate 144 to selectively establish a target maximum boost pressure. For example, the maximum boost pressure of the turbine 138 may be changed based on an operating mode of the bi-fuel internal combustion engine 102. In various embodiments, wastegate 144 is controlled to be more closed (e.g., such that less of the exhaust gases are purged from the turbine 138, etc.) when the bi-fuel internal combustion engine 102 is consuming a fuel with a first anti-knock index than when the bi-fuel internal combustion engine 102 is consuming a fuel with a second anti-knock index greater than the first anti-knock index. In these embodiments, the delivery system 104 may provide additional air to the combustion chambers 130 (e.g., to compensate for reduced volumetric efficiency of the bi-fuel internal combustion engine 102, when operating on a first fuel, to increase the performance capability of the bi-fuel internal combustion engine 102 when operating on the second fuel, etc.).

Figure 3:
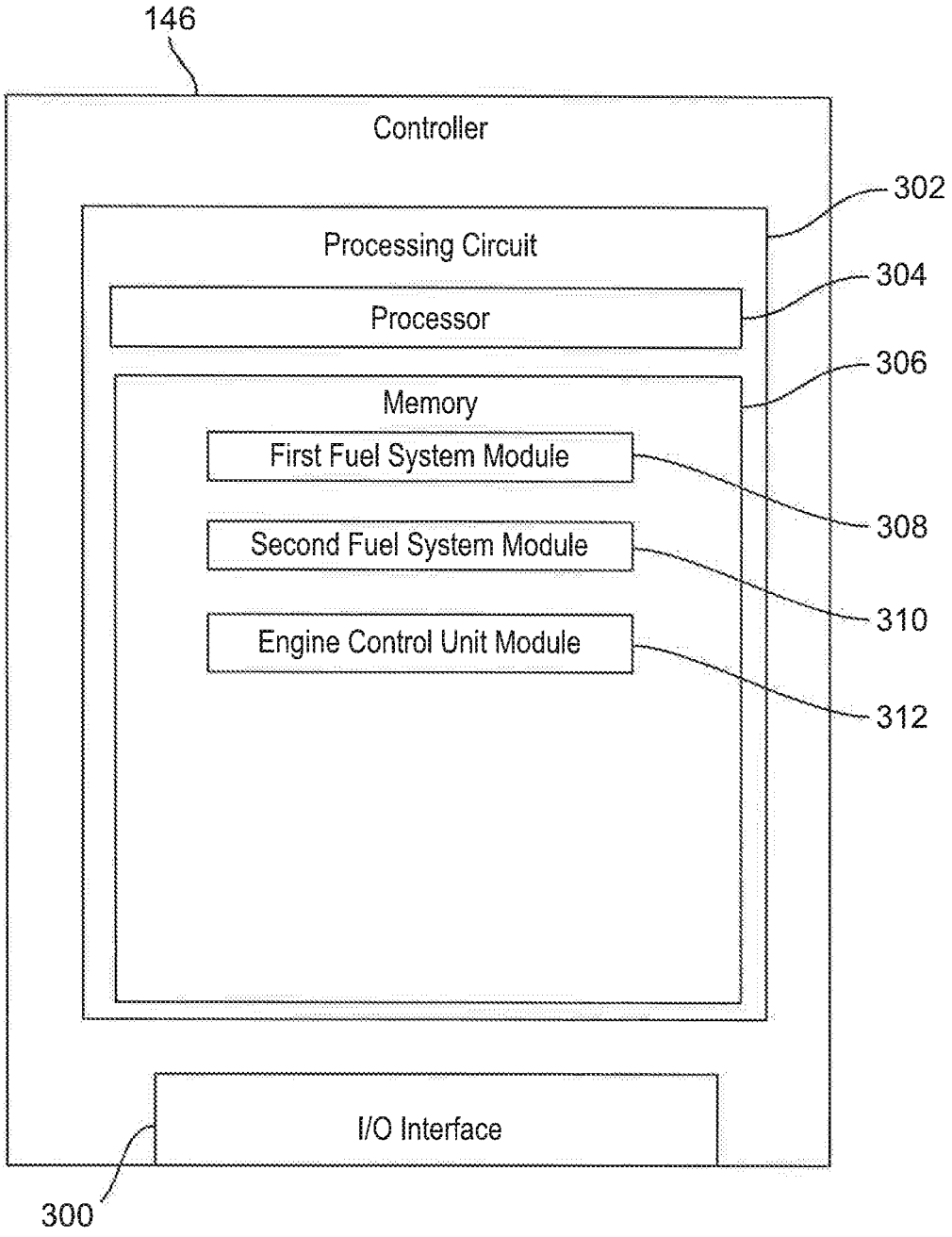
FIG. 3 is a block schematic diagram of an example controller for an example bi-fuel system.

FIG. 3 illustrates the controller 146, according to an example embodiment. The controller 146 includes an input/output (I/O) interface 300 and a processing circuit 302. The I/O interface 300 facilitates interaction between the processing circuit 302 and the pump 112 of the first fuel system 106, the pump 118 of the second fuel system 108, and the engine control unit 148. The processing circuit 302 includes a processor 304 and a memory 306. The memory 306 may include, but is not limited to, electronic, optical, magnetic, or any other storage or transmission device capable of providing the processor 304 with program instructions. The memory 306 may include a memory chip, EEPROM, EPROM, flash memory, or any other suitable memory from which the modules can read instructions. The instructions may include code from any suitable programming language.

The memory 306 includes a number of modules (e.g., microprocessors, ASIC, FPGAs, etc.). As shown in FIG. 3, the memory 306 includes a first fuel system module 308, a second fuel system module 310, and an engine control unit module 312. The first fuel system module 308 is configured to control interactions between the controller 146 and the pump 112 of the first fuel system 106. The second fuel system module 310 is configured to control interactions between the controller 146 and the pump 118 of the second fuel system 108. The engine control unit module 312 is configured to control interactions between the controller 146 and the engine control unit 148.

Figure 4:
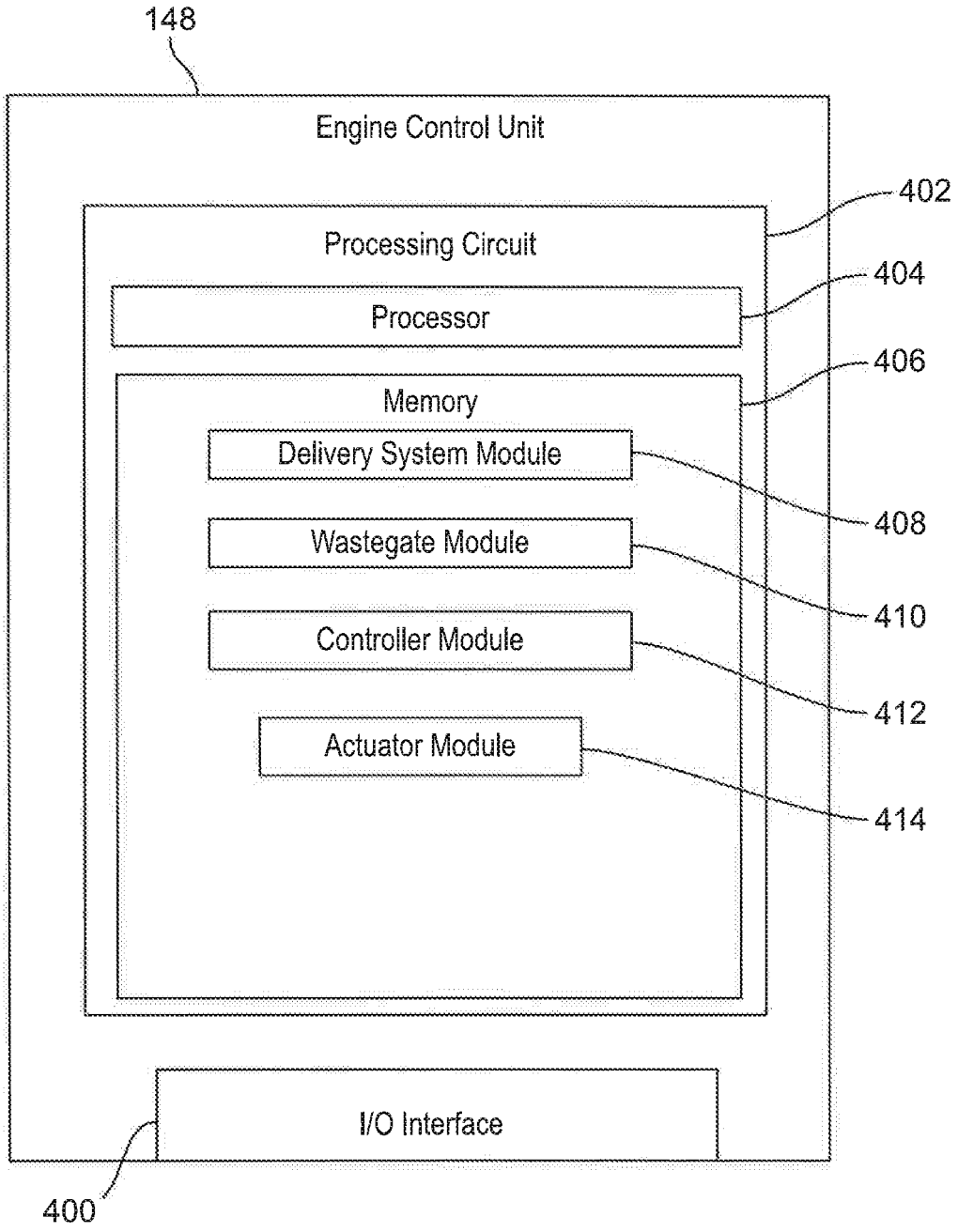
FIG. 4 is a block schematic diagram of an example engine control unit for an example bi-fuel system.

FIG. 4 illustrates the engine control unit 148 according to an example embodiment. The engine control unit 148 includes an I/O interface 400 and a processing circuit 402. The I/O interface 400 facilitates interaction between the processing circuit 402 and the delivery system 104, the wastegate 144, the controller 146, and the actuator 150. The processing circuit 402 includes a processor 404 and a memory 406. The memory 406 may include, but is not limited to, electronic, optical, magnetic, or any other storage or transmission device capable of providing the processor 404 with program instructions. The memory 406 may include a memory chip, EEPROM, EPROM, flash memory, or any other suitable memory from which the modules can read instructions. The instructions may include code from any suitable programming language.

The memory 406 includes a number of modules (e.g., microprocessors, ASIC, FPGAs, etc.). As shown in FIG. 4, the memory 406 includes a delivery system module 408, a wastegate module 410, a controller module 412, and an actuator module 414. The delivery system module 408 is configured to control interactions between the engine control unit 148 and the delivery system 104. The wastegate module 410 is configured to control interactions between the engine control unit 148 and the wastegate 144. The controller module 412 is configured to control interactions between the engine control unit 148 and the controller 146. The actuator module 414 is configured to control interactions between the engine control unit 148 and the actuator 150.

III. Example Valve Assembly and Camshaft

Figure 5:
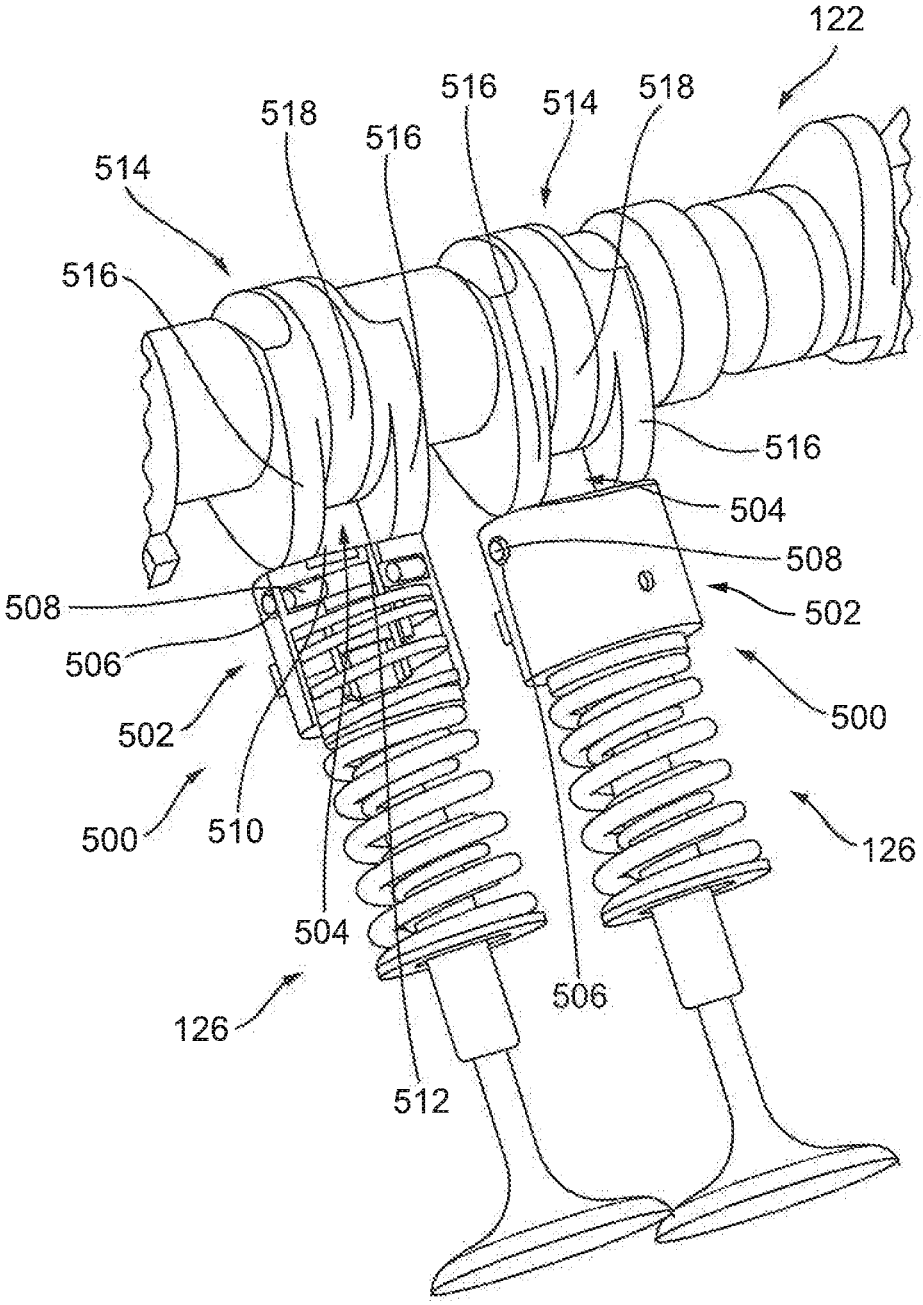
FIG. 5 is a perspective view of example valve assemblies and an example camshaft for an example bi-fuel system.
Figure 6:
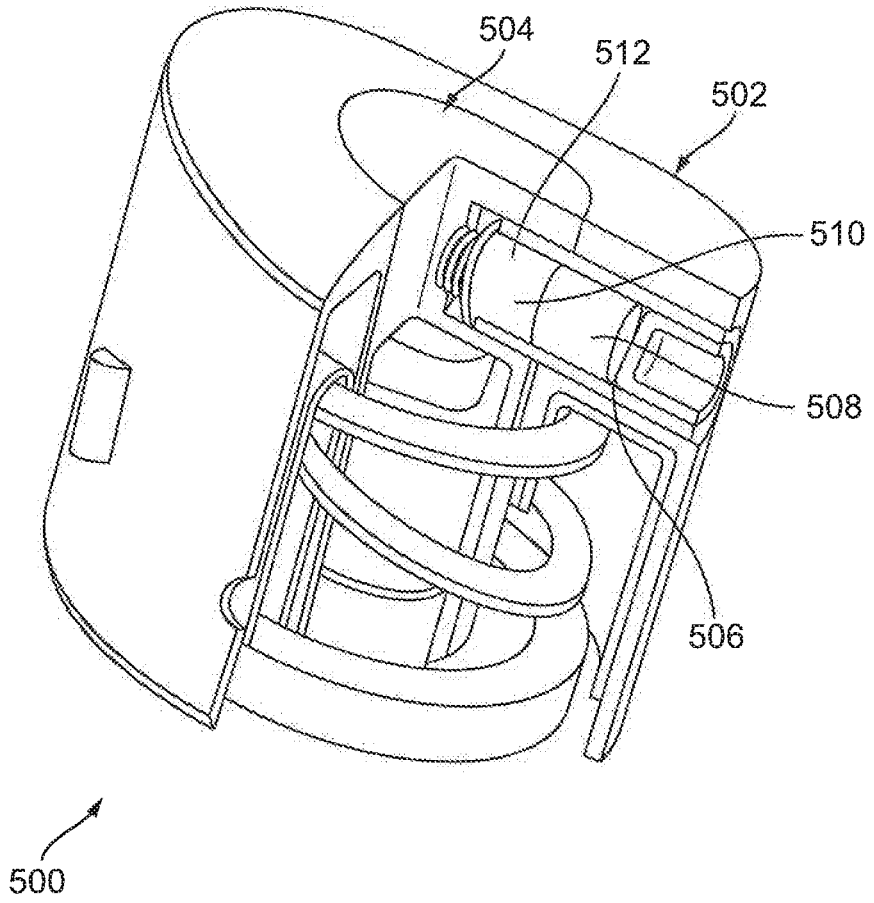
FIG. 6 is a perspective cross-sectional view of an example head assembly for an example valve assembly.

FIGS. 5 and 6 illustrate the valve assemblies 126 and camshaft 122 in greater detail. Each of the valve assemblies 126 includes a head assembly 500 having an outer member 502 and an inner member 504 that is selectively repositionable relative to the outer member 502. The outer member 502 and the inner member 504 are configured to selectively interface with the camshaft 122.

The outer member 502 includes an aperture 506 and a pin 508. The pin 508 is selectively repositionable (e.g., linearly translatable, etc.) within the aperture 506 to control an interaction between the outer member 502 and the inner member 504 of an associated valve assembly 126. The actuator 150 is configured to selectively reposition the pins 508 of all of the valve assemblies 126. The actuator 150 may control the valve assemblies 126 independently or collectively. For example, the pins 508 of adjacent valve assemblies 126 are coupled together such that the actuator 150 is capable of selectively repositioning all of the pins 508 simultaneously in some applications.

Similarly, the inner member 504 includes an aperture 510 and a pin 512. The pin 512 is selectively repositionable within the aperture 510 to control an interaction between the outer member 502 and the inner member 504 of an associated valve assembly 126. In an example embodiment, the pin 512 is configured to be selectively repositioned within the aperture 510 such that the pin 512 extends into the aperture 506 of the outer member 502. Similarly, in such an embodiment, the pin 508 is configured to be selectively repositioned within the aperture 506 such that the pin 508 extends into the aperture 510 of the inner member 504.

The valve assembly 126 is operable between a first position, where the outer member 502 interfaces with the camshaft 122 and the inner member 504 does not interface with the camshaft 122, and a second position, where both the outer member 502 and the inner member 504 interface with the camshaft 122. By selectively repositioning the pin 508, the actuator 150 is configured to establish the valve assembly 126 in either the first position or the second position.

The camshaft 122 includes a plurality of cams 514. Each of the cams 514 interfaces with two valve assemblies 126, one valve assembly 126 being an inlet to the combustion chamber 130 and one valve assembly 126 being an outlet from the combustion chamber 130. Each of the cams 514 has a pair of outer lobes 516 and an inner lobe 518. While only two of the cams 514 are shown, it is understood that the bi-fuel internal combustion engine 102 may include four, six, eight, or more cams 514 and a corresponding number of valve assemblies 126.

The outer lobes 516 establish a first intake lift profile, and the inner lobe 518 establishes a second intake lift profile different from the first intake lift profile. In this way, the cams 514 may define different closing timings for the associated valve assemblies 126. The closing timings are each defined by an inlet valve closing (IVC) time, an inlet valve opening (IVO) time, an exhaust valve closing (EVC) time, and an exhaust valve opening (EVO) time. The IVC time occurs when the piston 131 is positioned such that the valve assembly 126 is closed and prevents air and/or fuel from entering the combustion chamber 130. The IVO time occurs when the piston 131 is positioned such that the valve assembly 126 is fully open and facilitates air and/or fuel to enter the combustion chamber 130. The EVC time occurs when the piston 131 is positioned such that the valve assembly 126 is closed and prevents air and/or fuel from exiting the combustion chamber 130. The EVO time occurs when the piston 131 is positioned such that the valve assembly 126 is fully open and facilitates air and/or fuel to exit the combustion chamber 130. The closing timings are defined based on an angle of the crankshaft 136 known as a crank angle, between zero and seven-hundred and twenty degrees.

As will be explained in more detail herein, the closing timings are related to a volume of air and/or fuel trapped (e.g., contained, sealed, etc.) within an associated combustion chamber 130, at a position of the piston 131 at the IVC time, and changing the closing timings can change the dynamic compression ratios of the combustion chambers 130. In various embodiments, each of the combustion chambers 130 has the same dynamic compression ratio (e.g., when the cams 514 are uniform, etc.).

The dynamic compression ratio, C, is determined by $$C = \frac{\frac{\pi}{4} b^2 L_{IVC} + V_{Clearance}}{V_{Clearance}} \tag{1}$$

where b is the diameter of the combustion chamber 130 in inches, $L_{IVC}$ is the length of rod 137 adjusted for the IVC time (e.g., dynamic stroke length, etc.), and $V_{Clearance}$ is the clearance volume of the combustion chamber 130 (i.e., the minimum volume in the combustion chamber when the piston 131 is at top dead center (TDC)), etc.) in cubic inches. $L_{IVC}$ is determined by $$R_{HD}=0.5L_{Stroke}*\sin(t_{IVC}) \tag{2}$$

$$R_{CL}=0.5L_{Stroke}*\cos(t_{IVC}) \tag{3}$$

$$P_1=\sqrt{L_{\mathrm{Rod}}^2-R_{\mathrm{HD}}^2} \tag{4}$$

$$P_2=P_1-R_{CL} \tag{5}$$

$$L_{IVC}=0.5L_{stroke}-P_2+L_{Rod} \tag{6}$$

where $R_{HD}$ is the horizontal displacement of the rod 137 is inches, $L_{Stroke}$ is the stroke length of the piston 131 in inches, $t_{IVC}$ is the IVC time in degrees, $R_{CL}$ is the distance of the rod 137 from a centerline of the crankshaft 136 in inches, $P_1$ is a first rise of the piston 121 in inches, and $P_2$ is a second rise of the piston 121 in inches. In various embodiments, the dynamic compression ratios for all of the combustion chambers 130 are the same, and thus, the dynamic compression ratio of the bi-fuel internal combustion engine 102 is the same as the dynamic compression ratio of any one of the combustion chambers 130.

It is assumed hereafter that all of the combustion chambers 130 have the same dynamic compression ratio. However, it is understood that the combustion chambers 130 could have different dynamic compression ratios in some embodiments. It is understood that Equation 1 makes assumptions as to the volumetric efficiency of the combustion chamber 130 and piston 131, as well as assumptions as to an altitude at which the bi-fuel internal combustion engine 102 is operating. These factors could be considered for more precise calculation of the dynamic compression ratios of the combustion chambers 130.

The dynamic compression ratio is different from a static compression ratio. A static compression ratio is determined by comparing a volume of a compression chamber when a piston is at TDC and a volume of the compression chamber when the piston is at bottom dead center (BDC). The static compression ratio is greatest when the piston at TDC and least when the piston is at BDC. Because the dynamic compression ratio is based on the position of the piston 131 at the IVC time, the dynamic compression ratio can be changed by changing the IVC time. In this way, the time (e.g., angle of the crankshaft 136, crank angle, etc.) at which the minimum dynamic compression ratio occurs can be varied.

The outer lobes 516 of the cams 514 are configured to interface with the outer member 502 of associated valve assemblies 126. The inner lobes 518 of the cams 514 are configured to selectively interface with the inner member 504 of associated valve assemblies 126. When a valve assembly 126 is in the first position, the outer member 502 interfaces with the outer lobes 516 and the inner member 504 does not interface with the inner lobe 518. When the valve assembly 126 is in the second position, the outer member 502 interfaces with the outer lobes 516 and the inner member 504 interfaces with the inner lobe 518.

It is understood that other similar arrangements of the valve assembly 126 and the camshaft 122 are possible and could be implemented with the bi-fuel internal combustion engine system 100. For example, the camshaft 122 may include additional lobes similar to the outer lobes 516 and the inner lobe 518. Other similar variable valve timing or valve life changing mechanisms and devices may be implemented instead of, or in addition to, the valve assemblies 126 and the camshaft 122.

IV. Example Operation of Example Bi-Fuel System

By using the actuator 150 to place the valve assemblies 126 in the first position or the second position, the controller 146, through the engine control unit 148, can change the closing timings of the valve assemblies 126. Changing the closing timings of the valve assemblies 126 causes the volume of air and/or fuel trapped within an associated combustion chamber 130 to change. Changing the volume of air and/or fuel trapped within a combustion chamber 130 causes the dynamic compression ratio of the bi-fuel internal combustion engine 102 to change. Changing the dynamic compression ratio changes operation of the bi-fuel internal combustion engine 102 and may, for example, cause the bi-fuel internal combustion engine 102 to produce more or less torque and/or power and/or cause the bi-fuel internal combustion engine 102 to consume more or less fuel.

As previously mentioned, the first fuel, utilized by the first fuel system 106, and the second fuel, utilized by the second fuel system 108, have different fuel properties, such as anti-knock indices. To account for these different fuel properties, the controller 146 may alter the position of the valve assemblies 126 to change the IVC time such that the dynamic compression ratio of the bi-fuel internal combustion engine 102 is changed.

Table 1 below illustrates an example operation of the valve assemblies 126 with a constant maximum boost pressure of the turbine 138. In this example, the first fuel has an anti-knock index, $A_1$, lower than an anti-knock index, $A_2$, of the second fuel.

TABLE 1

Example operation of the valve assemblies 126.

| Fuel | Anti-Knock Index of Fuel | Position of the Valve Assemblies 126 | Dynamic compression ratio of the Bi-Fuel Internal Combustion Engine 102 | Closing Timings |
|---|---|---|---|---|
| First Fuel | $A_1$ | First Position | $C_1$ | $t_{IVC1}$<br>$t_{IVO1}$<br>$t_{EVC1}$<br>$t_{EVO1}$ |
| Second Fuel | $A_2 > A_1$ | Second Position | $C_2 > C_1$ | $t_{IVC2} \neq t_{IVC1}$<br>$t_{IVO2}$<br>$t_{EVC2}$<br>$t_{EVO2}$ |

When the delivery system 104 is providing the first fuel to the bi-fuel internal combustion engine 102, the controller 146 may cause the valve assemblies 126 to be in the first position, where the outer member 502 interfaces with the outer lobes 516 and the inner member 504 does not interface with the inner lobe 518. In the first position, the valve assemblies 126 have a first IVC time, $t_{IVC1}$, a first IVO time, $t_{IVO1}$, a first EVC time, $t_{EVC1}$, and a first EVO time, $t_{EVO1}$, thereby causing the bi-fuel internal combustion engine 102 to have a first dynamic compression ratio at a first target time (e.g., $t_{IVC1}$, a crank angle of six-hundred degrees, etc.), $C_1$.

When the delivery system 104 is providing the second fuel to the bi-fuel internal combustion engine 102, the controller 146 may cause the valve assemblies 126 to be in the second position, where the outer member 502 interfaces with the outer lobes 516 and the inner member 504 interfaces with the inner lobe 518. In the second position, the valve assemblies 126 have a second IVC time, $t_{IVC2}$, a second IVO time, $t_{IVO2}$, a second EVC time, $t_{EVC2}$, and a second EVO time, $t_{EVO2}$, thereby causing the bi-fuel internal combustion engine 102 to have a second dynamic compression ratio at a second target time (e.g., $t_{IVC2}$, a crank angle of five-hundred and sixty degrees, etc.), $C_2$, greater than the first dynamic compression ratio.

In this way, the bi-fuel internal combustion engine 102 can be optimized for use with two different fuels by configuring the valve assemblies 126 and/or the camshaft 122 such that an optimal dynamic compression ratio for one of the fuels is achieved when the valve assemblies 126 are in the first position and an optimal dynamic compression ratio for the other of the fuels is achieved when the valve assemblies 126 are in the second position. Accordingly, the bi-fuel internal combustion engine 102 can be easily reconfigured (e.g., by a manufacturer, by a consumer, by a remanufacturer, etc.) for use with different combinations of fuels. For example, one camshaft 122 can be configured for use with gasoline and propane, and another camshaft 122 can be configured for use with gasoline and ethanol with the same valve assemblies 126 such that the bi-fuel internal combustion engine 102 can be configured for gasoline and propane by using one camshaft 122 and for use with gasoline and ethanol with another camshaft 122.

Figure 7:
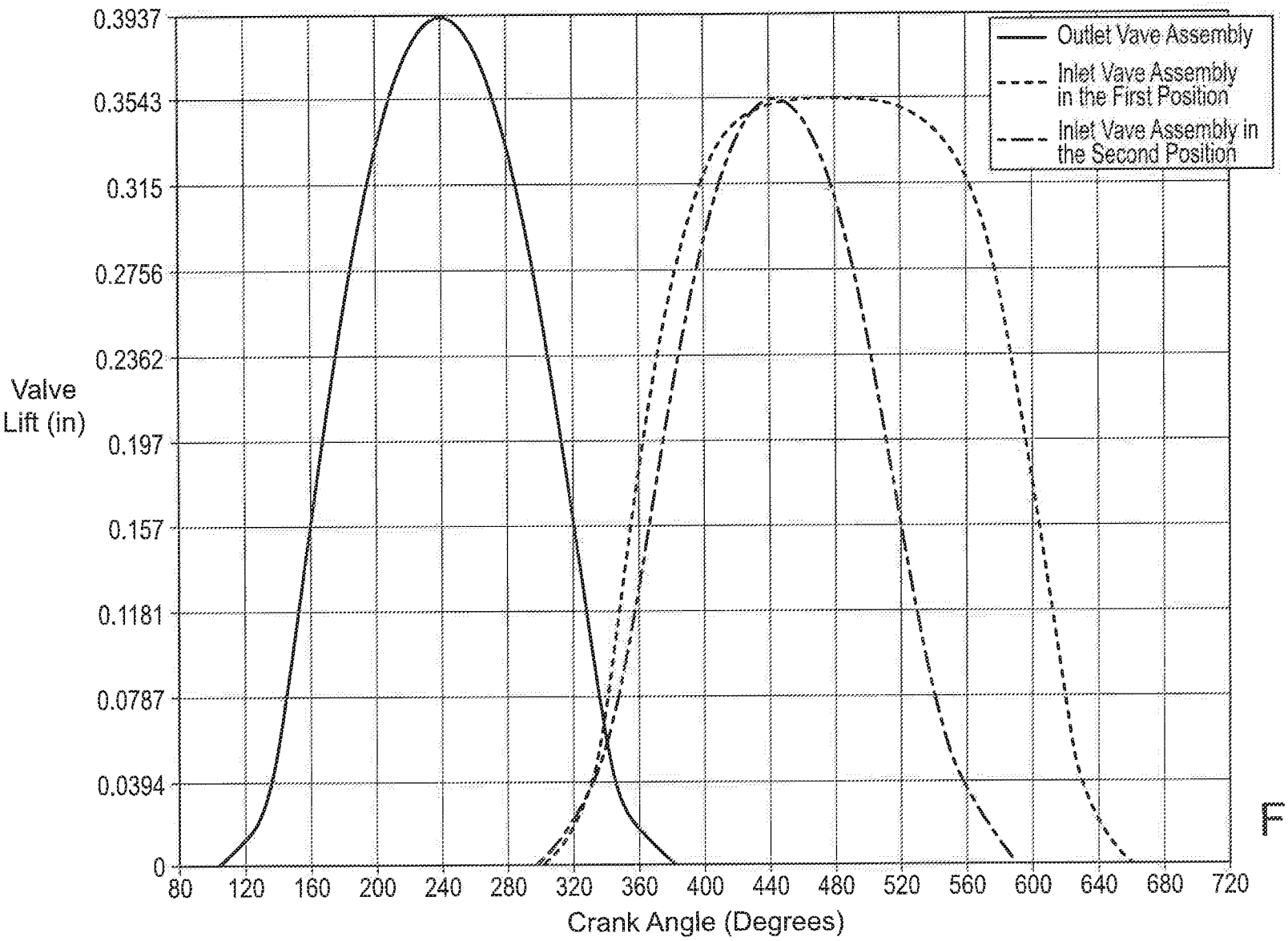
FIG. 7 is a plot showing various curves describing operation of example valve assemblies.
Figure 8:
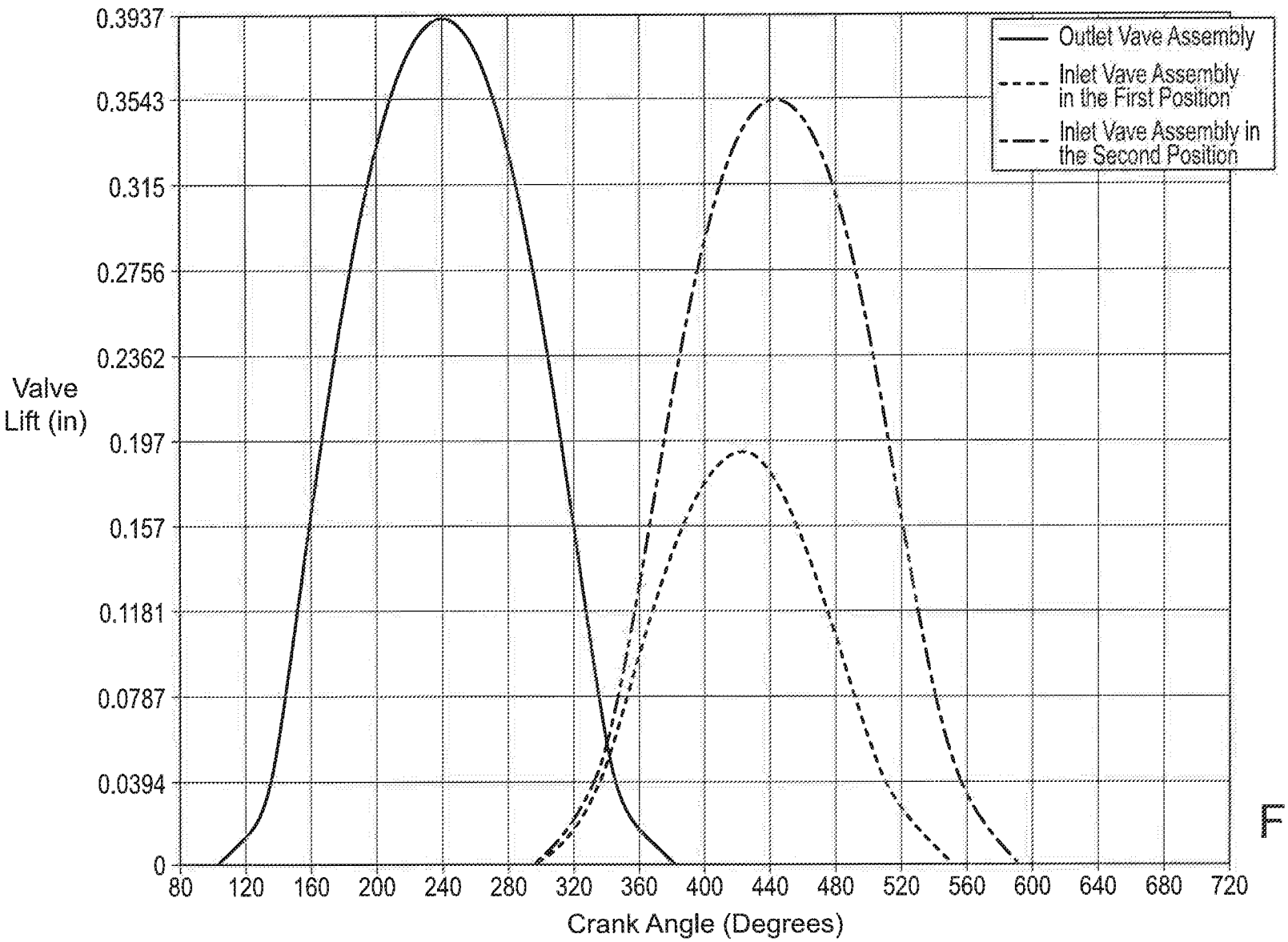
FIG. 8 is another plot showing various curves describing operation of example valve assemblies.

FIGS. 7 and 8 illustrate operation of the bi-fuel internal combustion engine 102 with the inlet valve assemblies 126 (e.g., the valve assemblies 126 controlling the flow of air and/or fuel into the combustion chambers 130, etc.) in the first position, shown in a dash-dash line, with the inlet valve assemblies 126 in the second position, shown in a dot-dash-dot line, and with the outlet valve assemblies 126 (e.g., the valve assemblies 126 controlling the flow of exhaust gases out of the combustion chambers 130, etc.) in a single position (e.g., the first position or the second position, etc.), shown in a solid line.

When the inlet valve assemblies 126 are in the first position, the bi-fuel internal combustion engine 102 has a first dynamic compression ratio and the inlet valve assemblies 126 are optimized for a first fuel with a first anti-knock ratio. When the inlet valve assemblies 126 are in the second position, the bi-fuel internal combustion engine 102 has a second dynamic compression ratio greater than the first dynamic compression ratio, and the inlet valve assemblies 126 are optimized for a second fuel with a second anti-knock ratio greater than the first anti-knock ratio.

In FIG. 7, the inlet valve assemblies 126 and/or the camshaft 122 are configured according to a late inlet valve closing (LIVC) strategy where the IVC time for the inlet valve assemblies 126 occurs at an angle of the crankshaft 136 in the first position that is greater than an angle of the crankshaft 136 at which the IVC time for the inlet valve assemblies 126 occurs in the second position. The LIVC strategy may be particularly advantageous because it facilitates high flow into the combustion chamber 130 even on fuel that may have lower fuel properties, thereby facilitating high load operation at high speeds of the bi-fuel internal combustion engine 102. When the LIVC strategy is implemented, the wastegate 144 may be controlled to be more closed (e.g., such that less of the exhaust gases are purged from the turbine 138, etc.) when the valve assemblies 126 are in the first position. In these embodiments, the delivery system 104 may provide additional air to the combustion chambers 130 (e.g., to compensate for reduced volumetric efficiency of the bi-fuel internal combustion engine 102, etc.) such that the torque produced by the bi-fuel internal combustion engine 102 remains approximately the same as when the valve assemblies 126 are in the second position.

In FIG. 8, the inlet valve assemblies 126 and/or the camshaft 122 are configured according to an early inlet valve closing (EIVC) strategy where the IVC time for the inlet valve assemblies 126 occurs at an angle of the crankshaft 136 in the first position that is less than an angle of the crankshaft 136 at which the IVC time for the inlet valve assemblies 126 occurs in the second position. To utilize the EIVC strategy, the camshaft 122 is configured such that the outer lobes 516 define a relatively short profile, compared to the profile of the outer lobes 516 used in the LIVC strategy, to lower the dynamic compression ratio. The EIVC strategy may be particularly advantageous because less flow into the combustion chamber 130 is utilized, thereby increasing the efficiency of the bi-fuel internal combustion engine 102.

In addition to changing the closing timings, the controller 146, through the engine control unit 148, can change the maximum boost pressure of the turbine 138. For example, the controller 146 may increase the maximum boost pressure of the turbine 138 when the fuel provided by the delivery system 104 is a relatively high octane fuel. In this way, the controller 146 may facilitate operation of the bi-fuel internal combustion engine 102 on a high-performance torque curve. In another example, the controller 146 may increase the maximum boost pressure when the fuel provided by the delivery system 104 is a relatively low octane fuel. In this way, the controller 146 may compensate for relatively low volumetric efficiency that may occur when utilizing the LIVC or EIVC strategies in order to achieve similar torque with the inlet valve assemblies 126 in both the first position and second position at lower intake manifold pressure levels.

Figure 9:
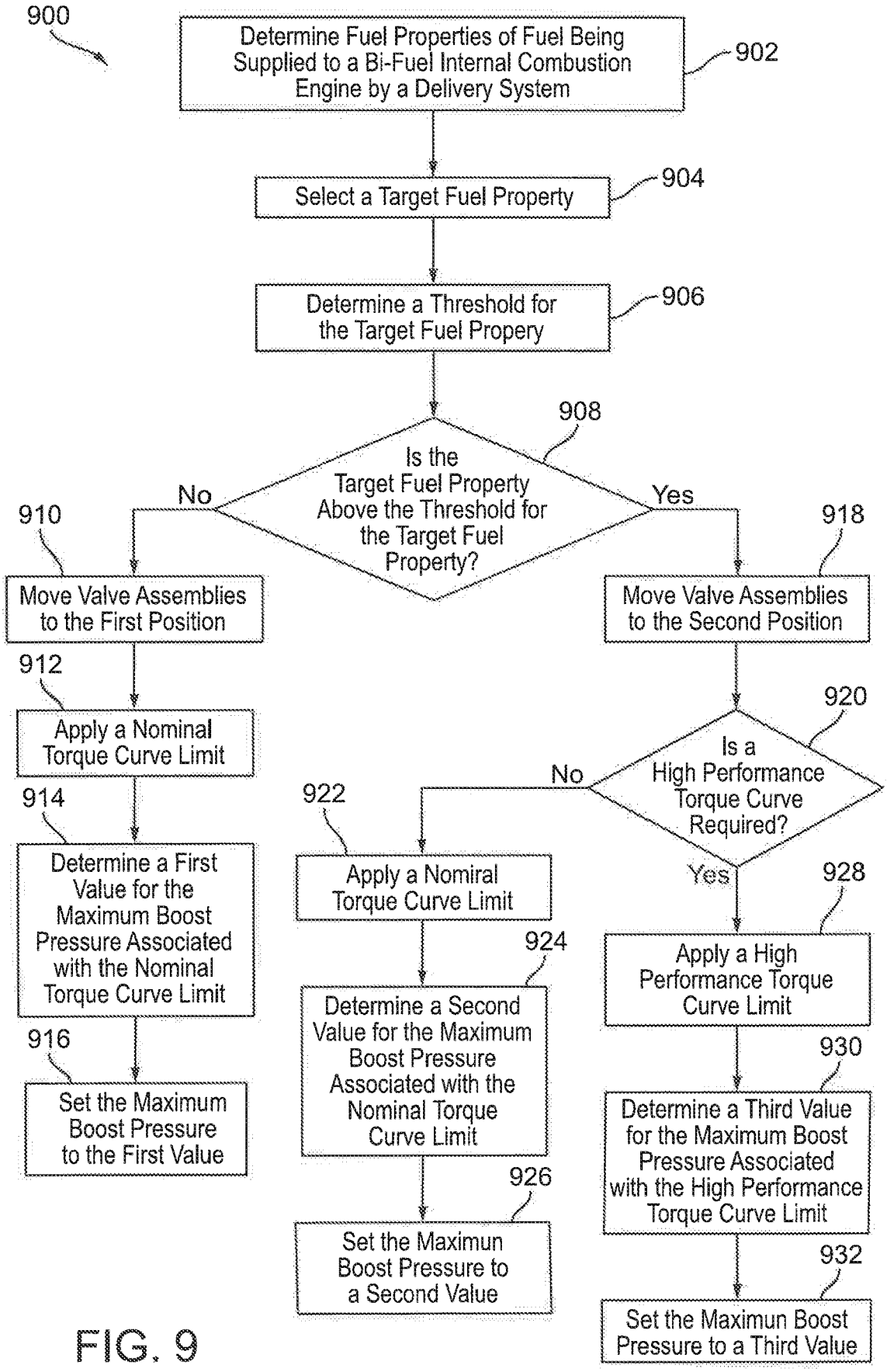
FIG. 9 is a flow chart for an example process of operating an example bi-fuel system.

FIG. 9 illustrates a process 900 for operating the bi-fuel internal combustion engine system 100 according to an example embodiment. The process 900 includes, in block 902, determining, by the controller 146 and/or the engine control unit 148, fuel properties of the fuel (e.g., the first fuel, the second fuel, etc.) being supplied to the bi-fuel internal combustion engine 102 by the delivery system 104. The fuel properties may be determined directly, such as by measurement of the fuel properties by a sensor, or indirectly, such as by knowledge of the fuel being provided by the delivery system 104 and subsequent correlation, by the controller 146 and/or the engine control unit 148, of the fuel with fuel properties associated with the fuel that are stored (e.g., in the memory 306, in the memory 406, in the delivery system module 408, etc.). In other applications, the controller 146 and/or the engine control unit 148 may communicate the fuel being provided by the delivery system 104 to an external device (e.g. mobile electronic device, server, database, etc.) to correlate the fuel with fuel properties associated with the fuel, and the external device may transmit the fuel properties to the controller 146 and/or the engine control unit 148.

For example, the engine control unit 148 may be communicable with a sensor that determines a position of an accelerometer pedal associated with the bi-fuel internal combustion engine 102, and may determine the fuel being supplied by the delivery system 104 based on the position of the accelerometer pedal. In another example, the engine control unit 148 may be communicable with a sensor in the delivery system 104 that determines the fuel being supplied by the delivery system 104 (e.g., based on a chemical composition, electrical resistance, etc.). In yet another example, the controller 146 may be communicable with a user interface (e.g., button, touch screen, etc.) that receives an input from a user, the input being a selection of a fuel to be delivered by the delivery system 104. Based on this selection, the controller 146 may, for example, control the pump 112 of the first fuel system 106 and/or the pump 118 of the second fuel system 108 to cause the delivery system 104 to deliver the selected fuel; the controller 146 may then determine that the delivery system 104 is providing the selected fuel. In an additional example, the controller 146 may be communicable with a sensor in the fuel source 110 of the first fuel system 106 and/or a sensor in the fuel source 116 of the second fuel system 108 that may determine the fuel being provided by the delivery system 104 based on, for example, a change in volume, pressure, or temperature of the fuel within the fuel source 110 of the first fuel system 106 and/or the fuel within the fuel source 116 of the second fuel system 108.

Once the fuel properties are determined, at block 904 the controller 146 and/or the engine control unit 148 selects a target fuel property. The target fuel property may be a default selection by (e.g., hard-coded into, etc.) the controller 146 or the engine control unit 148, or the target fuel property may be selected by a user through a user interface. For example, the target fuel property may be anti-knock ratio.

Once the target fuel property is determined, at block 906, the controller 146 and/or the engine control unit 148 determines a threshold for the target fuel property. For example, if the target fuel property is anti-knock ratio and the controller 146 has determined that the fuel being provided by the delivery system 104 is gasoline, the threshold may be, for example, eighty-seven, eighty-eight, eighty-nine, ninety, ninety-one, or ninety-three.

At block 908, the controller 146 and/or the engine control unit 148 determines if the target fuel property is above the threshold for the target fuel property. For example, the controller 146 may determine that the fuel being provided by the delivery system 104 is gasoline, that the anti-knock index of the gasoline being provided by the delivery system 104 is ninety, that the threshold for the anti-knock index of gasoline is ninety one, and that the target fuel property is therefore below the threshold for the target fuel property.

If the target fuel property is not above the threshold for the target fuel property and the valve assemblies 126 are in the second position, at block 910, the actuator 150 moves the valve assemblies 126 (e.g., the inlet valve assemblies 126, etc.) to the first position. Depending on the configuration of the valve assemblies 126 and the camshaft 122, this may cause the LIVC or the EIVC strategy to be implemented. If the valve assemblies 126 are already in the first position, as determined by the controller 146 and/or the engine control unit 148, the actuator 150 is not actuated.

At block 912, the controller 146 and/or the engine control unit 148 applies a nominal torque curve limit to the bi-fuel internal combustion engine 102. The nominal torque curve limit may limit fuel and/or air provided by the delivery system 104 to the bi-fuel internal combustion engine 102 to limit torque produced by the bi-fuel internal combustion engine 102 (e.g., at the crankshaft 136, etc.).

At block 914, the controller 146 and/or the engine control unit 148 determines a first value for the maximum boost pressure of the turbine 138 based on the nominal torque curve. For example, the controller 146 may determine that the maximum boost pressure of the turbine 138 needs to be set at a first value that is relatively high in order to sufficiently limit torque produced by the bi-fuel internal combustion engine 102 according to the nominal torque curve.

At block 916, setting, the controller 146 and/or the engine control unit 148 sets the maximum boost pressure of the turbine 138 to the first value. In this way, the controller 146 and/or the engine control unit 148 may cause the wastegate 144 to open and purge exhaust gases from the turbine 138 when the boost pressure within the turbine 138 exceeds the first value.

If the target fuel property is above the threshold for the target fuel property and the valve assemblies 126 are in the first position, at block 918, the actuator 150 moves the valve assemblies 126 (e.g., the inlet valve assemblies 126, etc.) to the second position. If the valve assemblies 126 are already in the second position, as determined by the controller 146 and/or the engine control unit 148, the actuator 150 is not actuated.

At block 920, the controller 146 and/or the engine control unit 148 determines if a high performance torque curve is required. For example, the controller 146 may be configured to independently determine if a high performance torque curve is required based on, for example, fuel remaining in the fuel source 110 of the first fuel system 106, fuel remaining in the fuel source 116 of the second fuel system 108, the maximum boost pressure of the turbine 138, the closing timings as established by the valve assemblies 126 and the camshaft 122, an exhaust temperature, an inlet air temperature, a fuel pressure, and other similar parameters and metrics. In some embodiments, a user inputs via a user interface whether a high performance torque curve is required or whether a nominal torque curve is required. For example, a user may determine that a high performance torque curve is required because the bi-fuel internal combustion engine system 100 is being implemented in a way where a high torque provided by the bi-fuel internal combustion engine 102 is necessary or beneficial.

If the high performance torque curve is not required, at block 922, the controller 146 and/or the engine control unit 148 applies a nominal torque curve limit to the bi-fuel internal combustion engine 102. The nominal torque curve limit may limit fuel and/or air provided by the delivery system 104 to the bi-fuel internal combustion engine 102 to limit torque produced by the bi-fuel internal combustion engine 102 (e.g., at the crankshaft 136, etc.).

At block 924, the controller 146 and/or the engine control unit 148 determines a second value for the maximum boost pressure of the turbine 138 based on the nominal torque curve. For example, the controller 146 may determine that the maximum boost pressure of the turbine 138 needs to be set at a second value that is relatively low in order to sufficiently limit torque produced by the bi-fuel internal combustion engine 102, according to the nominal torque curve.

At block 926, the controller 146 and/or the engine control unit 148 sets the maximum boost pressure of the turbine 138 to the second value. In this way, the controller 146 and/or the engine control unit 148 may cause the wastegate 144 to open and purge exhaust gases from the turbine 138 when the boost pressure within the turbine 138 exceeds the second value.

If the high performance torque curve is required, at block 928, the controller 146 and/or the engine control unit 148 applies a high performance torque curve limit to the bi-fuel internal combustion engine 102. The high performance torque curve limit may limit fuel and/or air provided by the delivery system 104 to the bi-fuel internal combustion engine 102 to limit torque produced by the bi-fuel internal combustion engine 102 (e.g., at the crankshaft 136, etc.).

At block 930, the controller 146 and/or the engine control unit 148 determines a third value for the maximum boost pressure of the turbine 138 based on the high performance torque curve. For example, the controller 146 may determine that the maximum boost pressure of the turbine 138 needs to be set at a third value that is relatively high in order to sufficiently limit torque produced by the bi-fuel internal combustion engine 102 according to the high performance torque curve.

At block 932, the controller 146 and/or the engine control unit 148 sets the maximum boost pressure of the turbine 138 to the third value. In this way, the controller 146 and/or the engine control unit 148 may cause the wastegate 144 to open and purge exhaust gases from the turbine 138 when the boost pressure within the turbine 138 exceeds the third value.

It is understood that a variety of other similar processes exist for controlling and operating the bi-fuel internal combustion engine system 100. Similarly, the various blocks described within the process 900 can be implemented in other orders to achieve similar control and operation of the bi-fuel internal combustion engine system 100.

V. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

While the bi-fuel internal combustion engine 102 has been described herein as being a spark-ignited internal combustion engine, it is understood that the bi-fuel internal combustion engine 102 may also be a compression-ignited internal combustion engine.

As utilized herein, the terms "substantially," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," "attached," and the like, as used herein, mean the joining of two components directly or indirectly to one another. Such joining may be stationary (e.g., permanent) or movable (e.g., removable or releasable). Such joining may be achieved with the two components or the two components and any additional intermediate components being integrally formed as a single unitary body with one another, with the two components, or with the two components and any additional intermediate components being attached to one another.

The terms "coupled," "in fluid communication," and the like, as used herein, mean the two components or objects have a pathway formed between the two components or objects in which a fluid (e.g., exhaust, fuel, air, etc.) may flow, either with or without intervening components or objects. Examples of fluid couplings or configurations for enabling fluid communication may include piping, channels, manifolds, or any other suitable components for enabling the flow of a fluid from one component or object to another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item, unless specifically stated to the contrary.

What is claimed is:

1. A bi-fuel internal combustion engine system, comprising:

a first fuel system;

a second fuel system;

a turbocharger comprising a turbine configured to receive exhaust gases; and a bi-fuel internal combustion engine configured to selectively consume one of a first fuel received from the first fuel system and a second fuel received from the second fuel system, the bi-fuel internal combustion engine comprising:

a camshaft having a cam, and a valve assembly positioned adjacent the camshaft and configured to interface with the cam, the valve assembly selectively repositionable between a first position and a second position, the valve assembly comprises a head assembly comprising:

an inner member, and an outer member disposed radially outward of the inner member such that the outer member surrounds an outer periphery of an upper portion of the inner member, the outer member comprising an aperture and a pin, the pin selectively movable within the aperture to control an interaction between the outer member and the inner member so as to move the valve assembly between the first position and the second position, wherein the bi-fuel internal combustion engine has a first dynamic compression ratio and a nominal torque curve limit when the valve assembly is in the first position, and a second dynamic compression ratio when the valve assembly is in the second position, the second dynamic compression ratio greater than the first dynamic compression ratio, wherein a maximum boost pressure of the turbine, when the valve assembly is in the first position, is set based on the nominal torque curve limit.

2. The bi-fuel internal combustion engine system of claim 1, wherein the cam defines a first lobe and a second lobe; and wherein the valve assembly interfaces with the first lobe and does not interface with the second lobe when the valve assembly is in the first position, and the valve assembly interfaces with both the first lobe and the second lobe when the valve assembly is in the second position.

3. The bi-fuel internal combustion engine system of claim 1, further comprising a controller;

wherein the bi-fuel internal combustion engine further comprises:

an actuator communicable with the controller, the actuator coupled to the valve assembly and configured to be actuated to selectively reposition the valve assembly between the first position and the second position; and an engine control unit communicable with the controller;

wherein at least one of the controller and the engine control unit is configured to determine whether the bi-fuel internal combustion engine is consuming the first fuel or the second fuel; and wherein the actuator is configured to cause the valve assembly to be in the first position when the bi-fuel internal combustion engine is consuming the first fuel, and in the second position when the bi-fuel internal combustion engine is consuming the second fuel.

4. The bi-fuel internal combustion engine system of claim 3, wherein the turbocharger further comprising:

a wastegate configured to selectively expel exhaust gases from the turbine when a pressure of the exhaust gases within the turbine exceeds a maximum boost pressure; and wherein the controller is configured to control the wastegate such that the maximum boost pressure has a first value when the valve assembly is in the first position and a second value different from the first value when the valve assembly is in the second position.

5. The bi-fuel internal combustion engine system of claim 1, wherein the first fuel is defined by a first research octane number that is less than ninety four and the second fuel is defined by a second research octane number that is greater than one-hundred.

6. The bi-fuel internal combustion engine system of claim 1, wherein the first fuel is gasoline and the second fuel is ethanol, natural gas, or propane.

7. A bi-fuel internal combustion engine system, comprising:

a first fuel system;

a second fuel system; and a bi-fuel internal combustion engine configured to selectively consume one of a first fuel received from the first fuel system and a second fuel received from the second fuel system, the bi-fuel internal combustion engine comprising:

a camshaft having a cam; and a valve assembly positioned adjacent the camshaft and configured to interface with the cam, the valve assembly selectively repositionable between a first position and a second position, the valve assembly comprises a head assembly comprising:

an inner member;

an outer member comprising an aperture and a pin, the pin selectively movable within the aperture to control an interaction between the outer member and the inner member so as to move the valve assembly between the first position and the second position; and a cam phaser coupled to the camshaft, the cam phaser operable to move the valve assembly between the first position and the second position, wherein in the first position, the cam phaser causes the cam shaft to rotate at a first rate, and in the second position, the cam phaser causes the camshaft to rotate at a second rate different from the first rate, wherein the bi-fuel internal combustion engine has a first dynamic compression ratio when the valve assembly is in the first position and a second dynamic compression ratio when the valve assembly is in the second position, the second dynamic compression ratio greater than the first dynamic compression ratio.

8. A bi-fuel internal combustion engine, comprising:

a delivery system configured to selectively receive a first fuel and a second fuel different from the first fuel;

a camshaft comprising a cam;

a valve assembly positioned adjacent the camshaft and configured to interface with the cam;

an actuator configured to selectively reposition the valve assembly between a first position and a second position; and a cam phaser coupled to the camshaft, the cam phaser operable to move the valve assembly between the first position and the second position, wherein:

the bi-fuel internal combustion engine has a first dynamic compression ratio when the valve assembly is in the first position and a second dynamic compression ratio when the valve assembly is in the second position, the second dynamic compression ratio being greater than the first dynamic compression ratio, and in the first position, the cam phaser causes the cam shaft to rotate at a first rate, and in the second position, the cam phaser causes the camshaft to rotate at a second rate different from the first rate.

9. The bi-fuel internal combustion engine of claim 8, wherein the cam defines a first lobe and a second lobe; and wherein the valve assembly interfaces with the first lobe and does not interface with the second lobe when the valve assembly is in the first position, and the valve assembly interfaces with both the first lobe and the second lobe when the valve assembly is in the second position.

10. The bi-fuel internal combustion engine system of claim 8, wherein the valve assembly comprises a head assembly comprising:

an inner member; and an outer member comprising an aperture and a pin, the pin selectively movable within the aperture to control an interaction between the outer member and the inner member.

11. The bi-fuel internal combustion engine of claim 8, further comprising an engine control unit communicable with the actuator and configured to cause the actuator to selectively reposition the valve assembly between the first position and the second position, the engine control unit configured to determine whether the delivery system is receiving the first fuel or the second fuel.

12. The bi-fuel internal combustion engine of claim 11, further comprising a turbocharger comprising:

a turbine configured to receive exhaust gases; and a wastegate communicable with the engine control unit and configured to selectively expel exhaust gases from the turbine when a pressure of the exhaust gases within the turbine exceeds a maximum boost pressure.

13. The bi-fuel internal combustion engine of claim 12, wherein the engine control unit is configured to control the wastegate such that the maximum boost pressure has a first value when the valve assembly is in the first position and a second value different from the first value when the valve assembly is in the second position.

14. The bi-fuel internal combustion engine of claim 11, wherein the engine control unit is configured to cause the valve assembly to be in the first position when the delivery system is receiving the first fuel and the second position when the delivery system is receiving the second fuel.

15. A method for controlling dynamic compression ratio of a bi-fuel internal combustion engine included in a bi-fuel internal combustion engine system comprising a delivery system, a camshaft having a cam, a valve assembly interfacing with the cam, and a turbocharger including a turbine, the method comprising:

determining fuel properties of a fuel being supplied to the bi-fuel internal combustion engine by the delivery system;

selecting a target fuel property;

determining a threshold for the target fuel property;

determining if the target fuel property is above the threshold;

in response to the valve assembly being in a second position and a determination that the target fuel property is not above the threshold, moving the valve assembly to a first position causing the bi-fuel internal combustion engine to have a first dynamic compression ratio;

in response to moving the valve assembly to the first position, applying a nominal torque curve limit to the bi-fuel internal combustion engine;

determining a first value for a maximum boost pressure of the turbine based on the nominal torque curve limit;

setting the maximum boost pressure of the turbine to the first value; and in response to the valve assembly being in the first position and a determination that the target fuel property is above the threshold, moving the valve assembly to the second position causing the bi-fuel internal combustion engine to have a second dynamic compression ratio greater than the first dynamic compression ratio.

16. The method of claim 15, wherein the bi-fuel internal combustion engine system also comprises a turbocharger including a turbine, and wherein the method further comprises:

in response to moving the valve assembly to the second position, determining if a high performance torque curve is required;

in response to determining that the high performance torque curve is not required, applying a nominal torque curve limit to the bi-fuel internal combustion engine;

determining a second value for a maximum boost pressure of the turbine based on the nominal torque curve limit; and setting the maximum boost pressure of the turbine to the second value.

17. The method of claim 16, further comprising:

in response to determining that the high performance torque curve is required, applying a high performance torque curve limit to the bi-fuel internal combustion engine;

determining a third value for a maximum boost pressure of the turbine based on the high performance torque curve limit; and setting the maximum boost pressure of the turbine to the third value.

18. An internal combustion engine, comprising:

a camshaft having a cam;

a valve assembly positioned adjacent to the camshaft and configured to interface with the cam, the valve assembly selectively repositionable between a first position in which the internal combustion engine has a first dynamic compression ratio and a second position in which the internal combustion engine has a second dynamic ratio that is greater than the first dynamic compression ratio; and a cam phaser coupled to the camshaft, the cam phaser operable to move the valve assembly between the first position and the second position, wherein:

the valve assembly is configured to have an early inlet valve closing in the first position so as to increase a fuel efficiency of the internal combustion engine, the valve assembly is configured to have a late inlet valve closing in the second position so as to allow high load and high speed operation of the engine, and in the first position, the cam phaser causes the cam shaft to rotate at a first rate, and in the second position, the cam phaser causes the camshaft to rotate at a second rate different from the first rate.

19. The internal combustion engine of claim 18, further comprising:

an actuator coupled to the valve assembly and configured to be actuated to selectively move the valve assembly between the first position and the second position; and a controller communicable with the actuator, the controller configured to:

in response to demand for increase fuel efficiency of the engine, cause the actuator to move the valve into the first position so as to cause the early inlet valve closing, and in response to a high load and high speed operation of the internal combustion, cause the actuator to move the valve assembly into the second position so as to cause a late inlet valve closing of the valve assembly.

20. A bi-fuel internal combustion engine system, comprising:

a first fuel system;

a second fuel system;

a bi-fuel internal combustion engine configured to selectively consume one of a first fuel received from the first fuel system and a second fuel received from the second fuel system, the bi-fuel internal combustion engine comprising:

a camshaft having a cam; and a valve assembly positioned adjacent the camshaft and configured to interface with the cam, the valve assembly selectively repositionable between a first position and a second position; and a cam phaser coupled to the camshaft, the cam phaser operable to move the valve assembly between the first position and the second position, wherein:

the bi-fuel internal combustion engine has a first dynamic compression ratio when the valve assembly is in the first position and a second dynamic compression ratio when the valve assembly is in the second position, the second dynamic compression ratio greater than the first dynamic compression ratio, and in the first position, the cam phaser causes the cam shaft to rotate at a first rate, and in the second position, the cam phaser causes the camshaft to rotate at a second rate different from the first rate.

21. A bi-fuel internal combustion engine, comprising:

a delivery system configured to selectively receive a first fuel and a second fuel different from the first fuel;

a camshaft comprising a cam;

a turbocharger comprising a turbine configured to receive exhaust gases;

a valve assembly positioned adjacent the camshaft and configured to interface with the cam, the valve assembly comprises a head assembly comprising:

an inner member; and an outer member disposed radially outward of the inner member such that the outer member surrounds an outer periphery of an upper portion of the inner member, the outer member comprising an aperture and a pin, the pin selectively movable within the aperture to control an interaction between the outer member and the inner member; and an actuator configured to selectively reposition the valve assembly between a first position and a second position;

wherein:

the bi-fuel internal combustion engine has a first dynamic compression ratio and a nominal torque curve limit when the valve assembly is in the first position, and a second dynamic compression ratio when the valve assembly is in the second position, the second dynamic compression ratio being greater than the first dynamic compression ratio, and a maximum boost pressure of the turbine, when the valve assembly is in the first position, is set based on the nominal torque curve limit.

22. A method for controlling dynamic compression ratio of a bi-fuel internal combustion engine included in a bi-fuel internal combustion engine system comprising a delivery system, a camshaft having a cam, a valve assembly interfacing with the cam, and a turbocharger including a turbine, the method comprising:

determining fuel properties of a fuel being supplied to the bi-fuel internal combustion engine by the delivery system;

selecting a target fuel property;

determining a threshold for the target fuel property;

determining if the target fuel property is above the threshold;

in response to the valve assembly being in a second position and a determination that the target fuel property is not above the threshold, moving the valve assembly to a first position causing the bi-fuel internal combustion engine to have a first dynamic compression ratio;

in response to the valve assembly being in the first position and a determination that the target fuel property is above the threshold, moving the valve assembly to the second position causing the bi-fuel internal combustion engine to have a second dynamic compression ratio greater than the first dynamic compression ratio, in response to moving the valve assembly to the second position, determining if a high performance torque curve is required;

in response to determining that the high performance torque curve is not required, applying a nominal torque curve limit to the bi-fuel internal combustion engine;

determining a second value for a maximum boost pressure of the turbine based on the nominal torque curve limit; and setting the maximum boost pressure of the turbine to the second value.

23. The method of claim 22, further comprising:

in response to determining that the high performance torque curve is required, applying a high performance torque curve limit to the bi-fuel internal combustion engine;

determining a third value for a maximum boost pressure of the turbine based on the high performance torque curve limit; and setting the maximum boost pressure of the turbine to the third value.

24. A valve assembly for a bi-fuel internal combustion engine, comprising:

a head assembly comprising:

an inner member; and an outer member disposed radially outward of the inner member such that the outer member surrounds an outer periphery of an upper portion of the inner member, the outer member comprising an aperture and a pin, the pin selectively movable within the aperture to control an interaction between the outer member and the inner member, wherein:

the valve assembly is positionable adjacent to a camshaft of the bi-fuel internal combustion engine so as to interface with a cam coupled to the camshaft, the valve assembly selectively repositionable between a first position in which the bi-fuel internal combustion engine has a first dynamic compression ratio and a nominal torque curve limit, and a second position in which the bi-fuel internal combustion engine has a second dynamic compression ratio greater than the first dynamic compression ratio, a maximum boost pressure, when the valve assembly is in the first position, of a turbine of a turbocharger of the bi-fuel internal combustion engine is set based on the nominal torque curve limit, and the movement of the pin within the aperture moves the valve assembly between the first position and the second position.

* * * * *